US005699571A

United States Patent [19]

Yowell

[11] Patent Number: 5,699,571

[45] Date of Patent: Dec. 23, 1997

[54] INFANT BEDDING APPARATUS

[76] Inventor: Donald H. Yowell, 2508 Easton Ave., Bethlehem, Pa. 18017

[21] Appl. No.: 633,227

[22] Filed: Apr. 16, 1996

[51] Int. Cl.[6] ..... A47C 21/04; A47D 7/00

[52] U.S. Cl. ..... 5/724; 5/98.3; 5/52.1; 5/655

[58] Field of Search ..... 5/98.3, 638, 643, 5/695, 724, 652.1, 655

[56] References Cited

U.S. PATENT DOCUMENTS

| | | | |
|---|---|---|---|
| 1,736,341 | 11/1929 | Eiser | 5/274 X |
| 2,924,832 | 2/1960 | Knowles | 5/695 X |
| 3,719,962 | 3/1973 | Burkley | 5/195 X |
| 5,016,301 | 5/1991 | Combs | 5/98.3 X |
| 5,423,099 | 6/1995 | Gulli | 5/638 |
| 5,561,876 | 10/1996 | Petruzella | 5/98.3 X |

*Primary Examiner*—Michael F. Trettel
*Attorney, Agent, or Firm*—Haynes and Boone LLP

[57] ABSTRACT

An infant bedding apparatus utilizes a mesh sleeping surface and a suspension device adapted to suspend the mesh sleeping surface above an existing sleeping surface of the bed thereby defining an air space between the existing sleeping surface and the mesh sleeping surface. The suspension device is a rigid rectangular frame having connectors, which may be elastomeric, for attachment to the mesh sleeping surface. Tensioners may be attached to the connectors for tensioning the mesh sleeping surface. As a result, the circulation of the fresh air in the area where body contact with the mesh sleeping surface occurs is improved when an infant is sleeping in a face-down or a substantially face-down position.

11 Claims, 2 Drawing Sheets

INFANT BEDDING APPARATUS

FIELD OF INVENTION

This invention relates generally to infant bedding and more particularly to a mesh sleeping surface for such bedding.

BACKGROUND OF THE INVENTION

New research suggests that sudden infant death syndrome (SIDS) may be the result of undetected or impaired deleterious changes in blood/gas chemistry. It is speculated that underdeveloped or poorly developed cellular areas of the brain are unable to detect the rising of blood gases such as CO2 and the falling of blood/gas levels such as O2, and relay this information adequately to the parasympathetic, sympathetic or autonomic nervous systems.

Present infant bedding is no different than adult bedding in basic structure. Sleeping surfaces generally comprise compacted materials, and although technically porous, they resist the free passage of air. Moreover, infant sleeping surfaces are often covered with a less porous or even substantially non-porous plastic coveting to resist stains caused by bedwetting. It is well know that infants are commonly placed in their cribs in a face-down position when they are left unattended at nap time or bedtime. As a result, sleeping in a face-down or substantially face-down position, severely limits breathing and the compact sleeping surface limits the circulation of fresh air in the area where body contact with the sleeping surface occurs.

The foregoing illustrates limitations of the known prior art. Thus it is apparent that it would be advantageous to provide an alternative directed to overcoming one or more of the limitations as set forth above. Accordingly, a suitable alternative is provided including features and benefits more fully disclosed hereinafter.

SUMMARY OF THE INVENTION

In one aspect of the present invention, this is accomplished by providing an infant bedding apparatus comprising a mesh sleeping surface and a suspension device adapted to suspend the mesh sleeping surface within existing framework of an infant bed.

In another aspect of the present invention, this is also accomplished by providing an infant bedding apparatus comprising a mesh sleeping surface and a suspension device adapted to suspend the mesh sleeping surface above an existing sleeping surface and within existing framework of an infant bed.

In a further aspect of the present invention, this is accomplished by providing an infant bedding apparatus comprising a mesh sleeping surface and a suspension device adapted to connect to existing framework of an infant bed and suspend the mesh sleeping surface above an existing sleeping surface of the bed.

The foregoing and other aspects will become apparent from the following detailed description of the invention when considered in conjunction with the accompanying drawing figures. It is to be expressly understood, however, that the figures are not intended as a definition of the invention, but are for the purpose of illustration only.

BRIEF DESCRIPTION OF THE DRAWINGS FIGURES

DETAILED DESCRIPTION OF THE INVENTION

Figure 1:
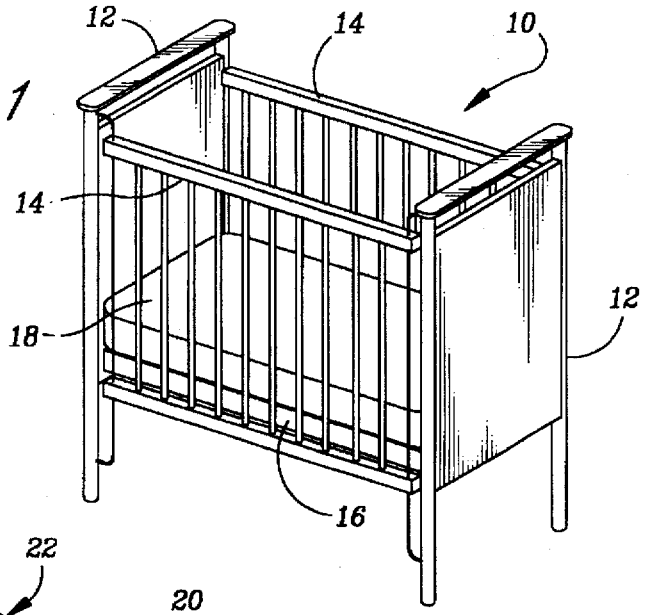
FIG. 1 is a perspective view illustrating an embodiment of an infant bed.
Figure 2:
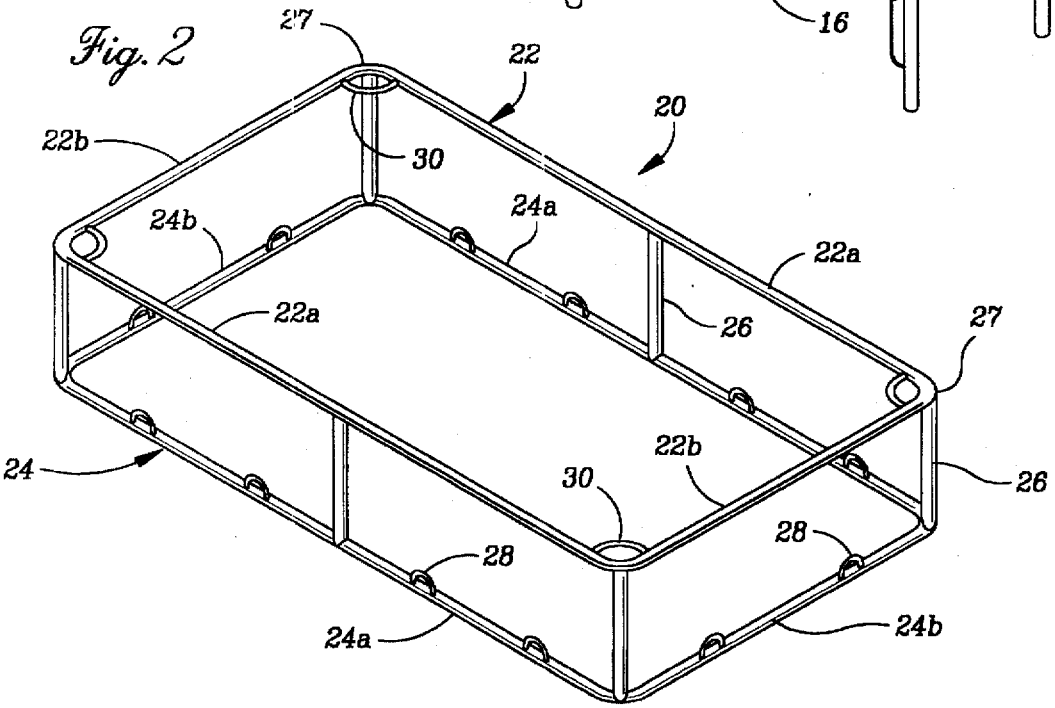
FIG. 2 is a perspective view illustrating an embodiment of a suspension device of the present invention.

Referring now to the drawings, FIGS. 1–5 illustrate an infant bed generally designated 10. Bed 10 includes existing framework generally comprising opposed end portions 12 and opposed side portions 14. One or both of the side portions 14 may be adapted to be movable between a raised position and a lowered position as is well known. A rectangular spring, partially shown at 16 supports a mattress 18 which provides a sleeping surface.

A suspension device, in accordance with this invention is adapted to suspend a mesh sleeping surface, to be discussed later, above mattress 18. The suspension device comprises a rigid rectangular frame generally designated 20 in FIG. 2. Frame 20 is of approximately the same rectangular dimensions as mattress 18 so as to fit within the above-described existing framework of bed 10.

A top frame portion 22 includes opposed side members **22*a* connected to opposed end members 22*b*. Similarly, a bottom frame portion 24 includes opposed side members 24*a* connected to opposed end members 24*b*. Top and bottom portions 22, 24, respectfully, are suitably interconnected and maintained spaced apart by spacer members 26 suitably positioned between the frame portions 22, 24. The frame portions 22, 24 and spacer members 26 may be formed of any suitable material such as metal or a synthetic material capable of being formed or fabricated so as to be substantially rigid. Bottom frame portion 24 rests on mattress 18 so that top frame potion 22 is suspended above mattress 18, see FIG. 4. A plurality of tension loops 28 are connected to bottom portion 24 and another plurality of tension loops 30 are connected at corners 27 of upper frame portion 22. These loops may be formed with the frame portions or suitably attached thereto. The purpose of loops 28, 30** will be explained later in greater detail.

Figure 3:
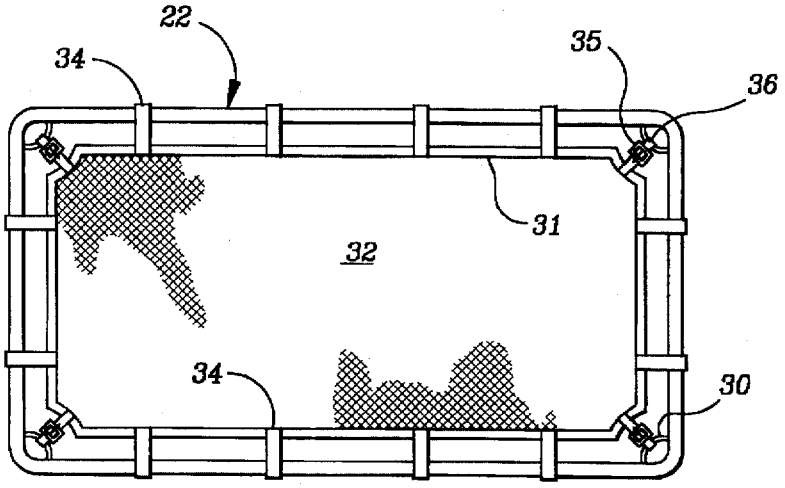
FIG. 3 is a plan view illustrating an embodiment of a mesh surface in combination with a suspension device of the present invention.
Figure 4:
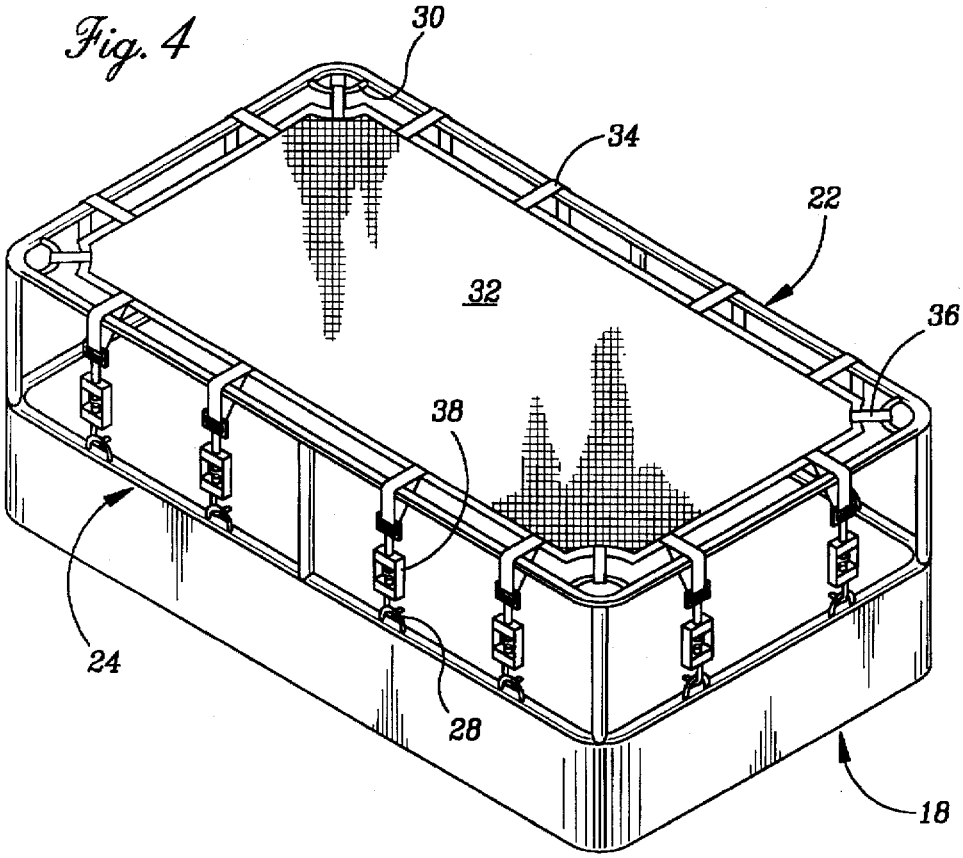
FIG. 4 is a perspective view illustrating an embodiment of a mesh surface in combination with a suspension device of the present invention.

A mesh sleeping surface 32 is provided to be attached to frame 20, see FIGS. 3 and 4. The mesh is preferably formed of soft cotton or cotton and polyester fibers woven into a fine mesh. By fine mesh is meant a mesh that would permit the free flow of air therethrough without forming an irritating or undesirable imprint of the mesh pattern on the human skin following contact therewith for an extended period of time. The mesh is supported adjacent upper frame portion 22 by tension adjustable straps 34 and tension adjustable straps 36. If preferred, edge portions 31 of mesh surface 32 maybe reinforced. Straps 34, preferably formed of a suitable elastomeric material, may be connected via turnbuckles 38 to loops 28 so that mesh surface 32 can be tensioned. Also, straps 36 which may or may not be formed of an elastomeric material, permit tensioning of mesh surface 32 at corner loops 30. This may be accomplished by providing buckles 35 in straps 36. Alteratively, suitable tensioning schemes other than buckles 35 may also be used if preferred, e.g. friction fastening devices.

Figure 5:
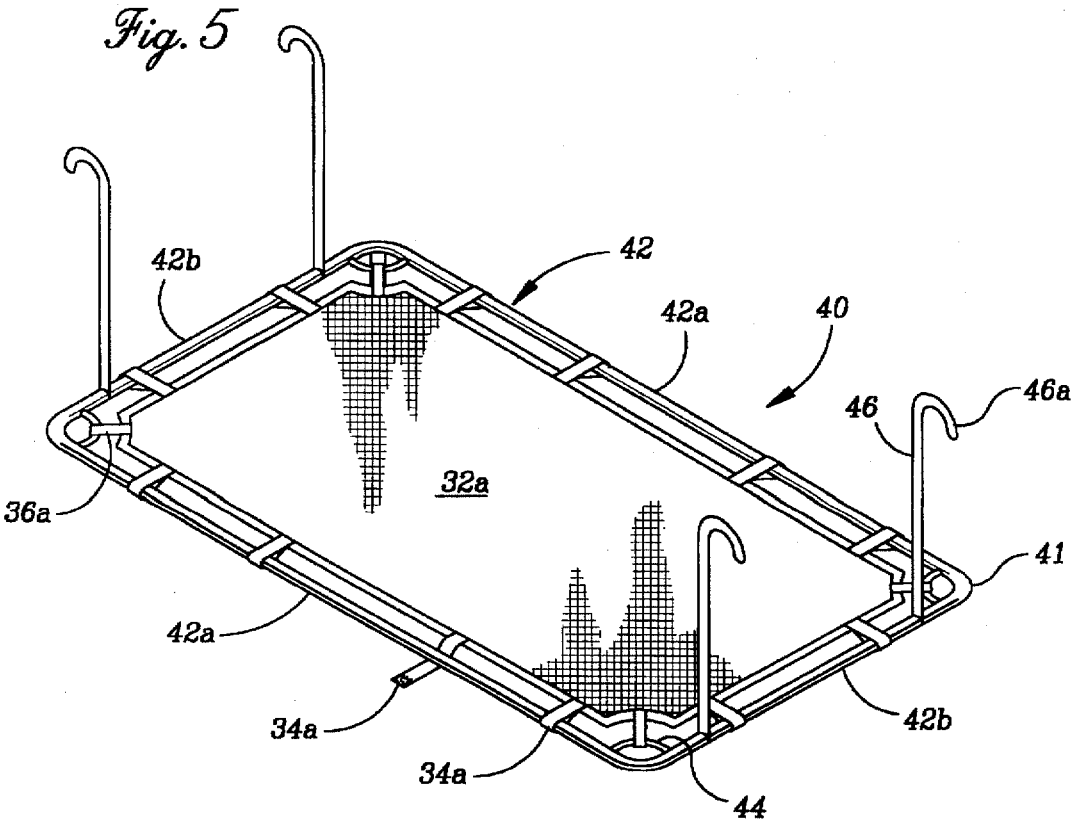
FIG. 5 is a perspective view illustrating another embodiment of a mesh surface in combination with a suspension device of the present invention.

An alternative suspension device is generally designated 40 as is illustrated in FIG. 5, and comprises a rigid rectangular frame member 42 of approximately the same rectangular dimensions as mattress 18 so as to fit within the above-described existing framework of bed 10. Frame member 42 includes opposed side members 42*a* connected to opposed end members 42*b* which may be formed of a suitable material such as metal or a synthetic material capable of being formed or fabricated so as to be substantially rigid. A plurality of tension loops 44 are connected at corners 41 of frame member 42. These loops may be formed with frame member 42 or suitably attached thereto.

Suspension arms 46 are suitably attached to opposed end members 42*b* and a hook portion 46*a* of each suspension arm 46 is adapted to engage opposed end portions 12 of bed 10 so as to suspend the device 40 within the existing framework of bed 10 at a position above mattress 18. A mesh sleeping surface 32*a*, similar to mesh sleeping surface 32, is provided to be attached to frame member 42 by elastomeric straps 34*a* and straps 36*a*. Straps 34*a* and straps 36*a* are similar to straps 34 and straps 36 described above. Straps 34*a* may be looped over opposed side members 42*a* and opposed end members 42*b* as illustrated in FIG. 5 wherein, for purposes of illustration only, one of the straps 34*a* is shown in an unsecured position with side member 42*a*. Straps 36*a* may or may not be formed of an elastomeric material and may be adjustable, as described above, to permit tensioning of mesh surface 32*a* at corner loops 44. Materials for the frame, mesh surface, elastomeric loops and straps may be formed to vary substantially without departing from the scope of the claimed invention While the invention has been illustrated and described in accordance with a preferred embodiment, it is recognized that variations and changes may be made therein without departing from the invention as set forth in the claims.

Having described the invention, what is claimed is:

1. An infant bedding apparatus comprising:

a mesh sleeping surface;

a suspension device supported by an existing sleeping surface and suspending the mesh sleeping surface within an existing framework of an infant bed, whereby an air space is defined between the existing sleeping surface and the mesh sleeping surface;

the suspension device being a rigid rectangular frame including upper and lower interconnected portions; and the mesh sleeping surface being connected to the rigid frame by connectors.

2. The infant bedding apparatus as defined in claim 1 wherein the connectors are elastomeric.

3. The infant bedding apparatus as defined in claim 1, and further comprising:

means attached to the elastomeric connectors for tensioning the mesh sleeping surface.

4. An infant bedding apparatus comprising:

a mesh sleeping surface;

a suspension device suspending the mesh sleeping surface above an existing sleeping surface within an existing framework of an infant bed, whereby air is free to circulate between the existing sleeping surface and the mesh sleeping surface;

the suspension device being a rigid rectangular frame mounted on the existing sleeping surface; and the mesh sleeping surface being connected to the rigid frame by connectors.

5. The infant bedding apparatus as defined in claim 4 wherein the connectors are elastomeric.

6. The infant bedding apparatus as defined in claim 4, and further comprising:

means for tensioning the elastomeric connectors.

7. The infant bedding apparatus as defined in claim 4 wherein the suspension device is suspended from the existing framework of the infant bed.

8. The infant bedding apparatus as defined in claim 7 wherein the mesh sleeping surface is connected to the rigid frame by connectors.

9. The infant bedding apparatus as defined in claim 8 wherein the connectors are elastomeric.

10. An infant bedding apparatus comprising:

a mesh sleeping surface;

a suspension device adapted to connect to an existing framework of an infant bed and suspend the mesh sleeping surface above an existing sleeping surface of the bed, whereby an air space is defined between the existing sleeping surface and the mesh sleeping surface;

the suspension device being a rigid rectangular frame; and the mesh sleeping surface being connected to the right frame by connectors.

11. The infant bedding apparatus as defined in claim 10 wherein the connectors are elastomeric.

* * * * *

UNITED STATES PATENT AND TRADEMARK OFFICE

CERTIFICATE OF CORRECTION

PATENT NO. : 5,699,571

DATED : December 23, 1997

INVENTOR(s) : Donald H. Yowell

It is certified that error appears in the above-identified patent and that said Letters Patent is hereby corrected as shown below:

Column 1, line 23, "coveting" should be -- covering --.

Column 2, line 42, "potion" should be -- portion --.

Claim 10, line 43, "right" should be -- rigid --.

Signed and Sealed this

FourthDay of August, 1998

Bruce Lehman

*Attest:*

BRUCE LEHMAN

*Attesting Officer*

*Commissioner of Patents and Trademarks*